US006227106B1

(12) United States Patent
Forehand

(10) Patent No.: US 6,227,106 B1
(45) Date of Patent: May 8, 2001

(54) MOTOR DRIVEN SEAL DEVICE

(76) Inventor: Michael E. Forehand, 5934 E. 96th Ct., Tulsa, OK (US) 74137

( * ) Notice: Subject to any disclaimer, the term of this patent is extended or adjusted under 35 U.S.C. 154(b) by 0 days.

(21) Appl. No.: 09/475,355

(22) Filed: Dec. 30, 1999

(51) Int. Cl.[7] ..... B41F 1/07
(52) U.S. Cl. ..... 101/31.1; 101/3.1
(58) Field of Search ..... 101/31.1, 28, 33, 101/18, 4, 3.1

(56) References Cited

U.S. PATENT DOCUMENTS

| | | | | |
|---|---|---|---|---|
| 1,807,170 | * | 5/1931 | Peterson | 101/3.1 |
| 2,348,556 | | 5/1944 | Papazian . | |
| 2,875,684 | | 3/1959 | Teel . | |
| 3,033,106 | | 5/1962 | Priesmeyer . | |
| 3,946,663 | * | 3/1976 | Engeriser | 101/3.1 |
| 4,278,017 | * | 7/1981 | Conjura | 101/31.1 |
| 4,476,781 | | 10/1984 | Kubacki et al. . | |
| 4,541,338 | | 9/1985 | Laverick et al. . | |
| 4,622,897 | | 11/1986 | Laverick et al. . | |
| 5,054,389 | | 10/1991 | Kuhlman et al. . | |
| 5,127,320 | | 7/1992 | Mei . | |
| 5,461,976 | | 10/1995 | Forehand . | |

FOREIGN PATENT DOCUMENTS

| | | |
|---|---|---|
| 883801 | 4/1961 | (GB) . |
| 953229 | 4/1964 | (GB) . |
| 596489 | 4/1978 | (SU) . |

* cited by examiner

*Primary Examiner*—John S. Hilten
*Assistant Examiner*—Anthony H. Nguyen
(74) *Attorney, Agent, or Firm*—Fellers, Snider, Blankenship, Bailey & Tippens, P.C.

(57) ABSTRACT

A motor driven seal device for impressing a design permanently on paper using a seal clip assembly including a male die and matching female counter from a new or existing manually operated seal. The invention incorporates a motor with housed gearing which operates a drive rod and compression sleeve. A frame extends from a base (or platen) onto which the motor is mounted. The motor shaft drivingly engages the drive rod which extends from the motor toward the platen. A compression sleeve capable of travel along the length of the drive rod in response to rotation of the drive rod engages the drive rod adjacent the platen. The seal clip is inserted between the compression sleeve and the platen. Rotation of the drive rod by the motor advances the compression sleeve toward the platen thereby pressing the die of the seal clip into matching engagement with the counter. A piece of paper inserted between the die and counter of the seal clip during this operation is embossed with the indicia contained on the die.

20 Claims, 6 Drawing Sheets

MOTOR DRIVEN SEAL DEVICE

BACKGROUND OF THE INVENTION

1. Field of the Invention

This invention relates to embossing seals for permanently impressing designs, symbols, or words used to certify signature or authenticate a paper document permanently with a blind embossing.

2. Background of the Invention

Seals for impressing a design, symbol or words into a piece of paper are a proven effective way to authenticate an original document and distinguish it from a forgery. Such seals can be manufactured to be one of a kind so as to apply an impression which is as nearly impossible to duplicate as currency.

Applying an impression with a seal has been known for centuries and continues to be an important part of modem business activity. In fact, application of seal technology to paper has grown to become an expected, essential part of routine business practice.

Seals to be used on paper are constructed with a seal clip including die and counter portions positioned to match when pressure is applied. When pressure is released, a clip spring connecting the die and counter acts to bias the two from each other. A document is placed between the die and counter combination such that when activated with enough force, the paper will be embossed or impressed permanently with the predetermined impression.

Many states and other jurisdictions and institutions require use of a seal to authenticate important transactional documents. The most common users are corporations, notary publics, government offices, libraries, courts, universities, and so forth. In each instance, the user has a seal manufactured for embossing paper with a combination of words, symbols and/or emblems that identify the institution or certifier with their unique permanent impression. This impression serves to forever verify authenticity of the document.

Most known seals are squeezed or lever activated. Such manual devices are directly dependent upon the individual person's strength. A concern has arisen that frequent use of these hand-operated devices may contribute over time to medical conditions such as Repetitive Stress Syndrome. Therefore, a need exists for a power driven seal device which is not dependent upon the strength or dexterity of the user. A need also exists for such a power driven seal device to be of a simple and reliable design.

Manual seals most commonly employed for notary or corporate seal service include a clamp frame into which the above-described seal clip is inserted. The clamp frame is designed to be gripped by the user's hand such that pressure applied by the hand presses the seal die into matching engagement with the counter. Devices such as these are commonly obtained as the notary license or certificate of incorporation are obtained. Due to the fact that most notaries and corporations already possess the above-described seal devices, it is desirable for a power driven seal device to employ the clip assembly of the hand-operated device. In this way the user is not required to have a new seal specially made to be included in the power driven device.

Power driven seal devices are known in the art, such as my U.S. Pat. No. 5,461,976. However, it has been found that devices such as this are unsuitable for use with the existing seal clip assemblies of the hand-operated seal. It is believed that this is because the clip spring seal assembly is not designed to withstand the long term repetitive impact shock of an impulse power device such as one including a solenoid.

Accordingly, a need exists for a power driven seal device which employs the seal clip of a hand-operated seal.

A need further exists for a power driven seal device which operates to apply a constant, steady force upon the seal clip which approximates or surpasses the force applied by the user's hand.

Additionally, since a motor driven seal device is an alternative to the inexpensive hand-operated seal, a need exists for a motor driven seal device which is simple and reliable in design.

SUMMARY OF THE INVENTION

This invention is a motor driven seal device for embossing paper with a permanent impression using a seal clip from an existing or new manual seal. The invention includes, generally, a base, a frame extending from a base, a motor with housed gearing mounted to said frame, a platen, a drive rod drivingly engaged to the motor extending from the motor toward the platen, a compression sleeve mounted to the drive rod capable of moving along the length of the drive rod in response to rotation of the drive rod and the seal clip inserted between the compression sleeve and the platen. The platen may be supported from the frame or base, or may be the base. A housing may be applied over the seal device in order to protect the mechanism or for purely aesthetic purposes.

A compression sleeve retainer is supported from the frame to retain the compression sleeve so that rotation of the drive rod causes the compression sleeve to move along the length of the drive rod depending upon its direction of rotation. The motor includes an output shaft drivingly engaged to the drive rod such that rotation of the shaft in turn rotates the drive rod in the desired direction. The direction of rotation of the shaft is dependent upon the direction of the electrical current applied to the motor.

The seal clip assembly includes a die and diametrically opposed matching counter combination with a clip spring connecting and biasing the die from the counter. The die includes any desired design such as a symbol, word, logo, or any combination thereof. Compression of the die into matching engagement with the counter thereby impresses the design in a piece of paper inserted between the die and counter.

The seal clip is inserted in the motor driven seal device of the present invention between the compression sleeve and the base/platen such that when the drive rod is rotated by the shaft of the motor in one direction, the compression sleeve is lowered toward the platen thereby compressing the seal clip therebetween. This places the die in matching engagement with the counter. The clip spring of the seal clip provides the spring tension to bias the die from the counter. Conversely, rotation of the drive rod through applying current in the opposite direction to the motor drivingly rotates the drive rod in the opposite direction. The compression sleeve secured by the compression sleeve retainer thereby moves in the opposite direction along the length of the drive rod away from the platen. The die is biased away from the counter (and the platen) by the clip spring of the seal clip assembly. The clip spring of the seal clip assembly thereby follows the compression sleeve in a direction alternating from an open position where the die is biased from the counter to a closed position where the die is in matching engagement with the counter.

An impression of the seal is applied to a document by positioning the paper in the seal clip assembly between the die and counter and activating the motor. The shaft of the motor rotates the drive rod causing the compression sleeve to apply force on the seal clip driving the die and counter portions together with great force. A permanent embossed impression of the seal on the document is created. The seal impression left by the motor driven seal device thereafter providing means of which authenticity of the document may occur.

As can be seen by the common seal impressions of FIG. 4, the use of seals is a common and essential part of business and governmental life. Due to the sheer number of such seal assemblies presently in use, it is a benefit for a device to replace the hand-operated seal device with a motorized device, such as the present invention, which employs the seal assembly removed from the hand-operated seal. In this way, the user can employ the motorized seal device of the present invention immediately, without the requirement of creating expensive customized die and counter pairs. Further, a single motorized seal device can be used interchangeably for many seal applications simply by exchanging the seal assembly between the compression sleeve and the platen.

It is thus an object of the present invention to provide a motor driven seal device for applying an impression on a document.

It is a further object of the present invention to provide a motor driven seal device which employs a seal clip of a manual seal.

It is still a further object of the present invention to provide a motor driven seal device which operates to apply a constant, steady force upon the seal clip.

A yet further object of the present invention is to provide a motor driven seal device which is simple and reliable in design.

A better understanding of the invention can be had from the following description taken in conjunction with the drawings.

DETAILED DESCRIPTION OF THE PREFERRED EMBODIMENT

Figure 1:
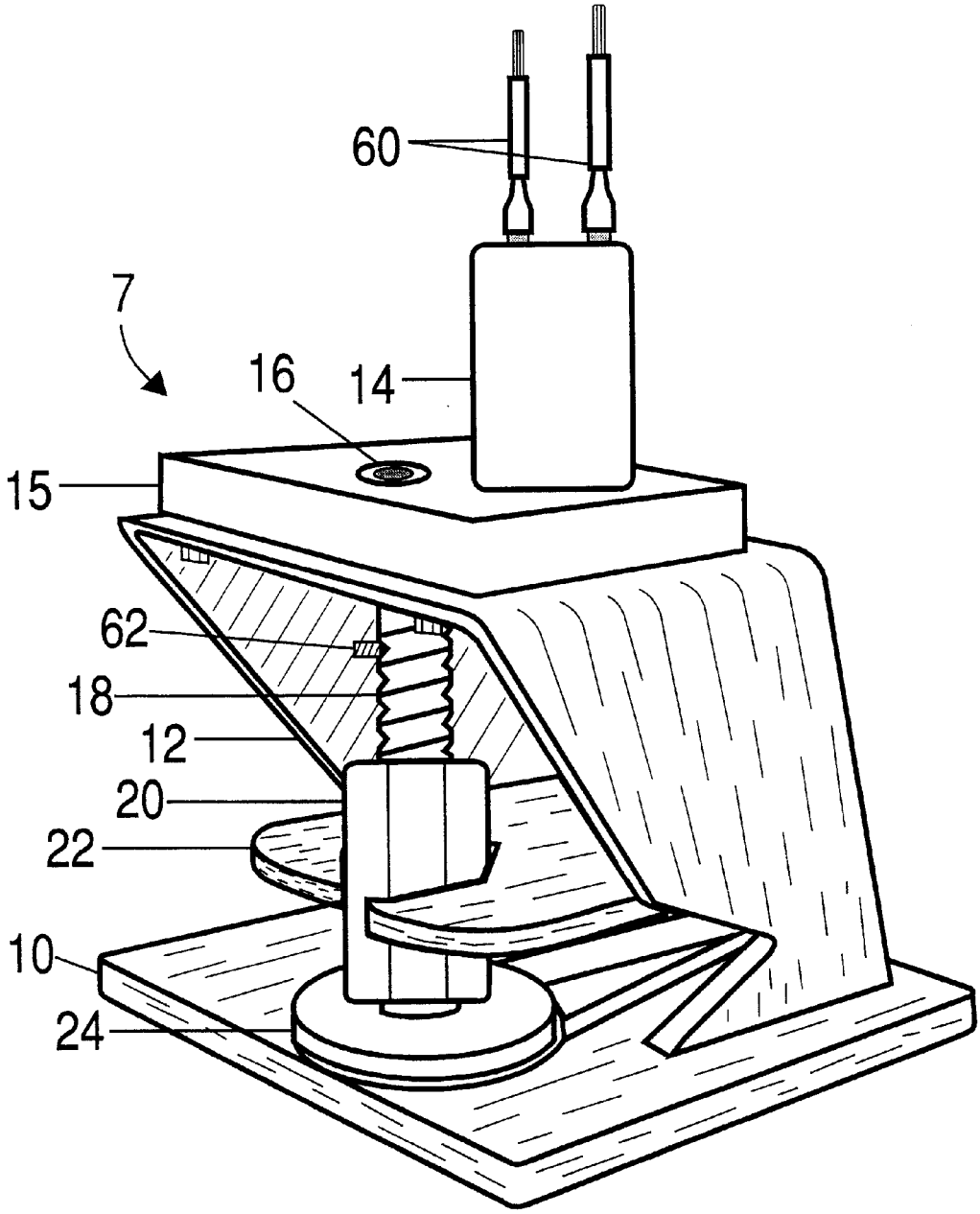
FIG. 1 is an isometric view of the power driven seal device of the present invention wherein the compression sleeve is applying pressure to match the die of the seal clip assembly with the counter.

Attention is directed to the drawings which show the combination employing a motor for activating a power driven seal device.

Attention is first directed to FIG. 1 which is an isometric view of the motor driven seal device 7 of the present invention, which includes, generally, a base (or platen) 10, supporting a frame 12 onto which a motor 14 with housed gearing 15 is mounted. Motor 14 includes an output shaft 16 drivingly connected to a drive rod 18 which extends from motor 14 through frame 12 toward base 10. A compression sleeve 20 is secured to the terminal, or second, end of drive rod 18 which extends toward base 10. A compression sleeve retainer 22 surrounds compression sleeve 20 thereby preventing its rotation. Compression sleeve 20 travels along the length of drive rod 18 in response to rotation of drive rod 18 by output shaft 16 of motor 14. Compression sleeve retainer 22, while preventing rotation of compression sleeve 20, does not prevent compression sleeve 20 from traveling along the length of drive rod 18. A seal clip assembly 24 from a new or existing manual seal is inserted in frame 12 between compression sleeve 20 and base 10. As compression sleeve 20 travels along drive rod 18 upon rotation of drive rod 18, compression sleeve 20 contacts and compresses seal clip assembly 24 thereby imprinting an image on a piece of paper that corresponds to an image on seal clip 24.

Figure 2:
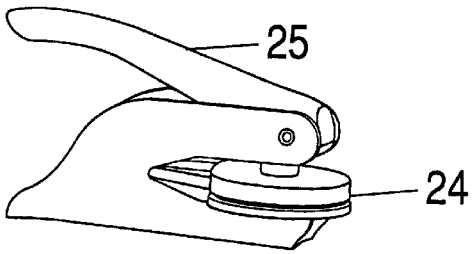
FIG. 2 is an isometric view of a prior art hand-operated seal.

FIG. 2 depicts a common manual hand seal 25 with seal clip assembly 24 installed therein. Manual hand-operated seal 25 is commonly employed for notary or corporate seal service. Manual hand seal 25 is designed to be gripped by the user's hand such that pressure applied by the hand applies pressure to clip assembly 24. A sheet of paper inserted in clip assembly 24 may be thereby impressed with the seal contained on the clip assembly 24.

Figure 3:
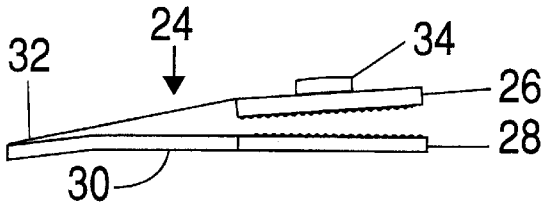
FIG. 3 is a side view of the seal clip removed from the hand-operated seal of FIG. 1.

FIG. 3 depicts clip assembly 24 in detail removed from manual hand seal 25 of FIG. 2. Clip assembly 24 includes female die 26 and a matching opposed male counter 28. Die 26 and counter 28 are retained in opposed position by clip spring 30. Clip spring 30, terminating at tail 32, acts to bias die 26 away from counter 28. Die 26 typically includes a nib 34 extending therefrom which generally engages manual hand seal 25 (of FIG. 2).

Manual hand seal devices such as device 25 of FIG. 2 are very common and obtained typically at the time of incorporation or notary licensure. Due to the large number of such devices presently in use, the clip assembly 24 from manual hand seal 25 (of FIG. 2) may be removed and inserted into the motor driven seal device 7 (FIG. 1) of the present invention.

Figure 4:
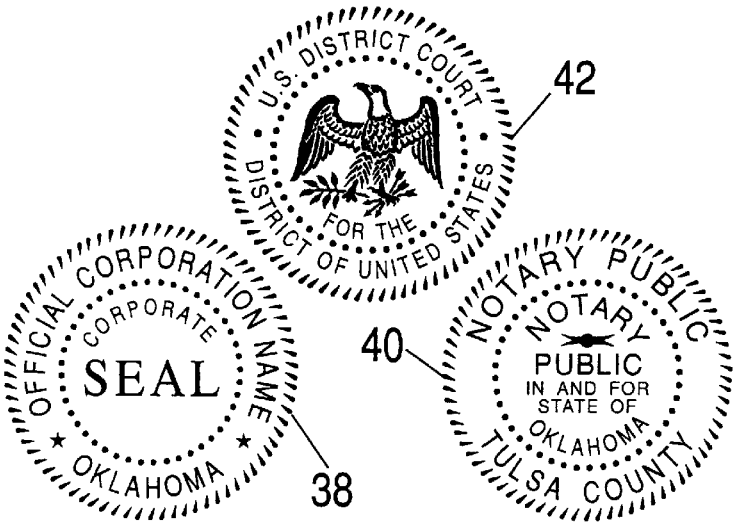
FIG. 4 illustrates common seal impressions formed by the seal clip assembly of FIG. 3.

Reference is next made to FIG. 4 in combination with FIG. 3. Seal clip 24 of FIG. 3 includes female die 26 and matching male counter 28. Die 26 and counter 28 may include any design, symbol, or words (or any combination thereof) necessary or desired to be impressed on a piece of paper. FIG. 4 depicts three examples of common seal impressions used to authenticate documents. Seal impression 38 is a typical corporate seal which would include the name of the corporation and perhaps a design recognizable as originating from the corporation. Such seals are commonly used in business transactions to authenticate official corporate documents such as stock certificates, minutes of corporate meetings, contracts, and other official corporate transactional documents.

Seal impression 40 is an example of a typical seal for a notary public. Such notary seals are widely used to authenticate original documents (and signatures thereon) which include wills, contracts, certificates of title for vehicles, and numerous other transactional documents where witness of a person's signature is required. Such notary certificates are essential where the possibility exists that the document, or the signatures thereon, are challenged in a legal proceeding.

Seal impression 42 is an example of a seal bearing the name and official symbol for a judicial body. Such seals are commonly applied by the clerk of the court to certify that a document has been officially filed with that court or that the document bears the authority of the court or judicial officer.

Figure 5:
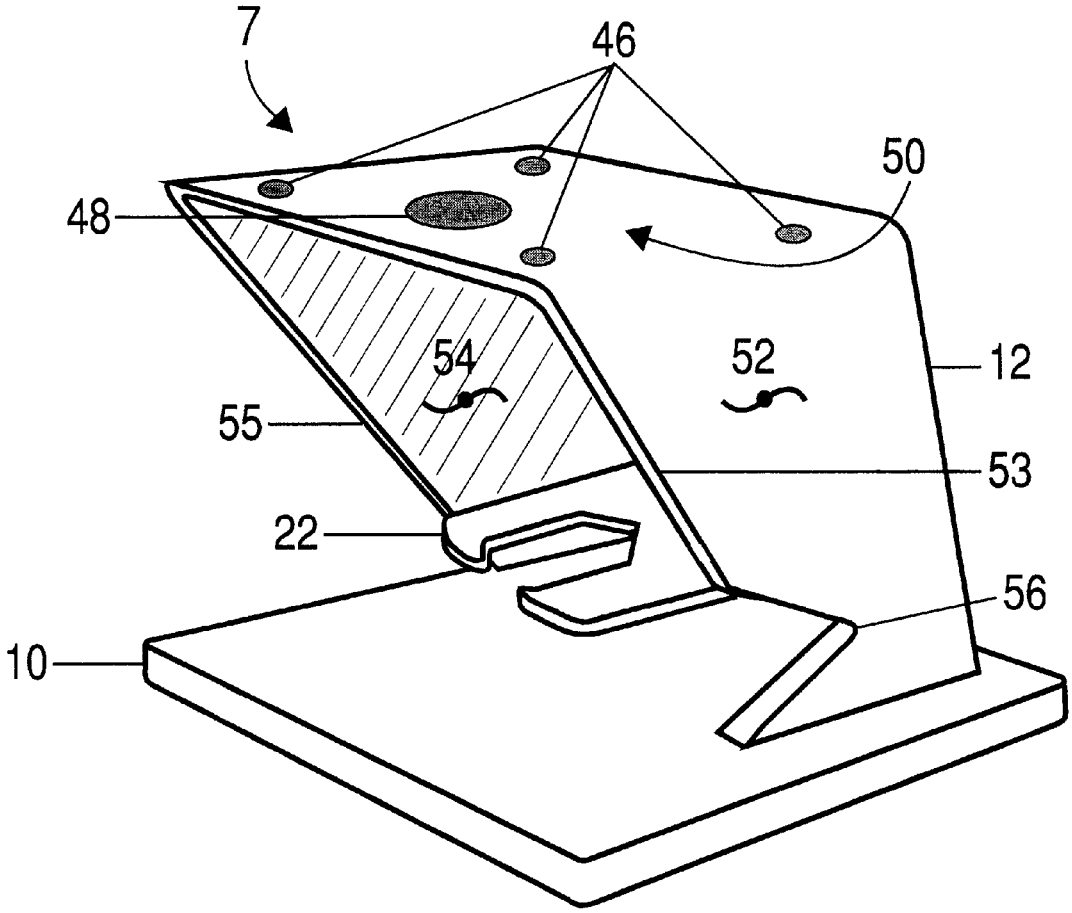
FIG. 5 is an isometric view of the frame of the motor driven seal device of the present invention extending from the base and including the compression seal retainer.

Referring next to FIG. 5 which depicts base 10 which supports, and from which frame 12 extends. FIG. 5 is the device 7 of FIG. 1 with motor 14, drive rod 18, compression sleeve 20, and seal clip assembly 24 removed. FIG. 5 also depicts compression sleeve retainer 22. Frame 12 is preferably secured to base 10 in any known manner such as welding or bolting. However, in an alternate embodiment, base 10 could be eliminated wherein the device 7 could be supported directly by frame 12 resting on a level surface. Base 10 and frame 12 are preferably constructed of metal, however, other materials, such as high impact resistant plastic could be substituted.

Base 10 is a platen against which die 26 is compressed in order to impress a sheet of paper. However, it is understood that a separate rigid surface could be substituted for the platen. If base 10 is eliminated as described above, a separate, rigid surface positioned substantially perpendicular to drive rod 18 would have to be substituted to act as a platen in order to support counter 28.

Frame 12 is substantially an inverted U-shaped structure to provide support and a mounting surface for motor 14 (of FIG. 1). Frame 12 includes a mounting surface 50 which is parallel to but separated from base 10 a sufficient distance as further described below. Side members 52 and 54 of frame 12 support mounting surface 50 the predetermined distance from base 10. Front edges 53 and 55 of side members 52 and 54 are angled from a larger width adjacent mounting surface 50 to a reduced width adjacent base 10 so as to provide a sufficient mounting surface 50 for a motor yet allow a piece of paper to be inserted directly beneath an output shaft mount hole 48 drilled through mounting surface 50. Accordingly, allowance of the proper positioning of the paper within device 7 is achieved. Side members 52 and 54 may also include a notch 56 therein to further allow access of a sheet of paper directly under output shaft hole 48.

Mounting surface 50 includes a plurality of holes 46 drilled therein to facilitate mounting of the motor (14 of FIG. 1) thereon as well as motor shaft hole 48 to allow shaft 16 (of FIG. 1) to extend therethrough.

Figure 6:
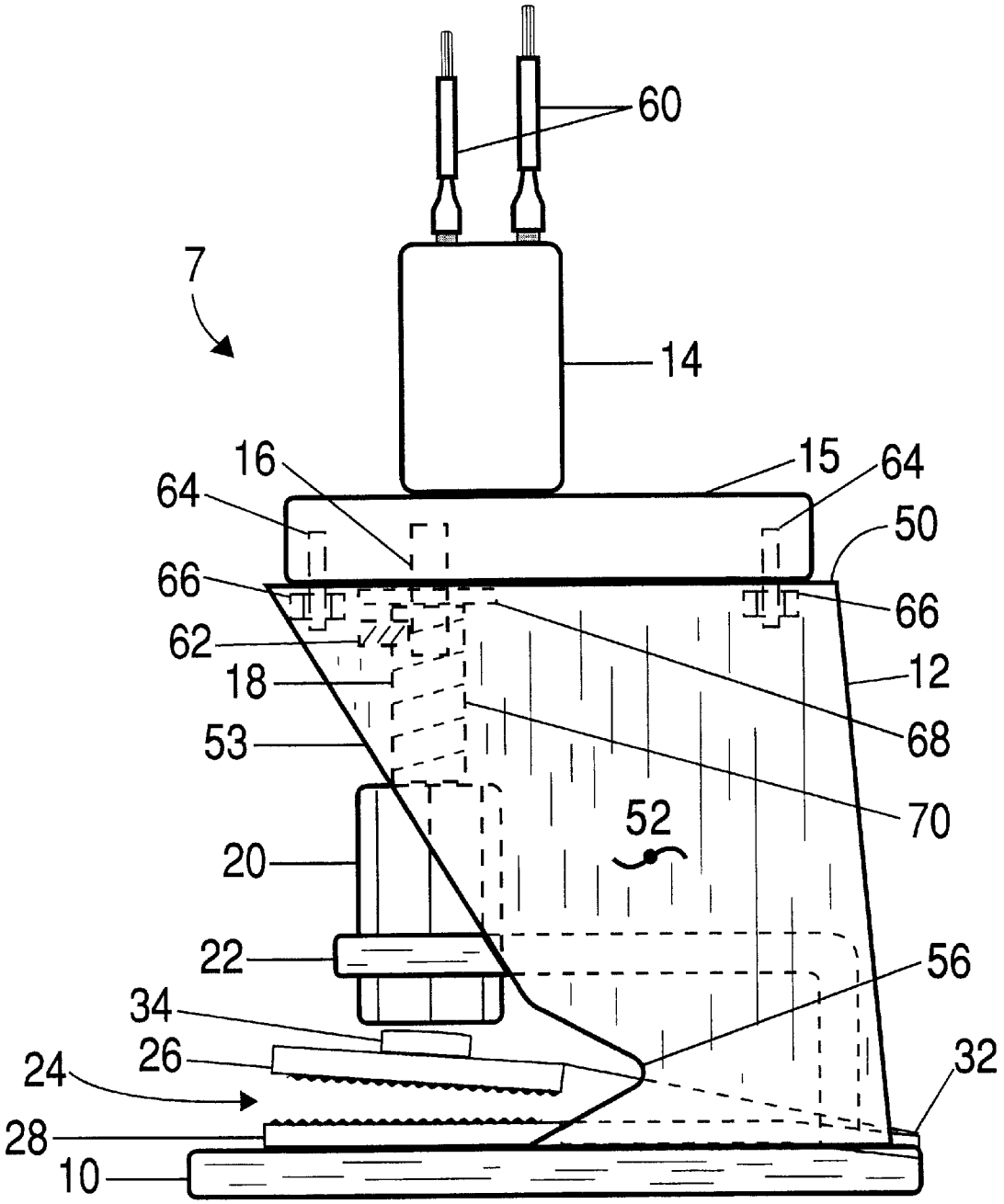
FIG. 6 is a side view of the motor driven seal device of the present invention with compression sleeve in the raised position.

FIG. 6, a side view of the motor driven seal device 7 of the present invention, shows motor 14 mounted thereon. Motor 14 includes internal gearing within housing 15 in order to provide rotation of output shaft 16. Motor 14 also includes electrical connectors 60 to provide a bi-directional electrical circuit to power motor 14 in a conventional manner such that power provided in a first direction translates into rotation of output shaft 16 in a first direction. Alternately, providing power to the electrical circuit through the second connector allows motor 14 to rotate output shaft 16 in the opposite direction. In the preferred embodiment, motor 14 is a gear motor including a gear housing 15 mounted to frame 12 on mounting surface 50. Suitable gear motors are available commercially. It has been found that a gear motor particularly suitable for this application is a permanent magnet 24 volt DC gear motor available commercially such as from W.W. Grainger, Inc. It should be understood, however, that other gear motors, or even other motors which include a shaft capable of rotation in both forward and reverse directions could be substituted.

Gear housing 15 of motor 14 is secured to mounting surface 50. The underside of gear housing 15 includes a plurality of screws 64 extending therefrom which match holes 46 of mounting surface 50 (of FIG. 5). There are four such screws 64 and holes 46 in the preferred embodiment, one adjacent each comer of gear housing 15. Bolts 66 are threaded onto screws 64 underneath mounting surface 50 thereby securing gear housing 15 to mounting surface 50. As such, gear housing 15 is secured to frame 12.

As stated above, gear motor 14 includes an output shaft 16 which extends from gear housing 15. Output shaft 16 extends through mounting surface 50 of frame 12 through output shaft mount hole 48 (FIG. 5).

A first end 70 of drive rod 18 is drilled out in order to receive a portion of output shaft 16 which extends below mounting surface 50. In the preferred embodiment, a thrust washer 68, is inserted between first end 70 of drive rod 18 and mounting surface 50. Output shaft 16 is retained within first end 70 of drive rod 18 by a set screw 62.

Drive rod 18 is drivingly connected to output shaft 16 such that rotation of output shaft 16 in either direction by gear motor 14 correspondingly rotates drive rod 18. Moreover, the longitudinal axis of drive rod 18 is coincident with the longitudinal axis of output shaft 16 such that rotation of output shaft 16 translates into rotation of drive rod 18.

Thrust washer 68 transfers the force from drive rod 18 to mounting surface 50 and thereby frame 12 when compression sleeve 20 is driven down toward base 10 in order to compress die 26 and counter 28. Without thrust washer 68, this force is transferred to output shaft 16 which could possibly cause damage to gear motor 14. Through the use of thrust washer 68, this force is transferred to, and dispersed through, frame 12 rather than output shaft 16.

Figure 7:
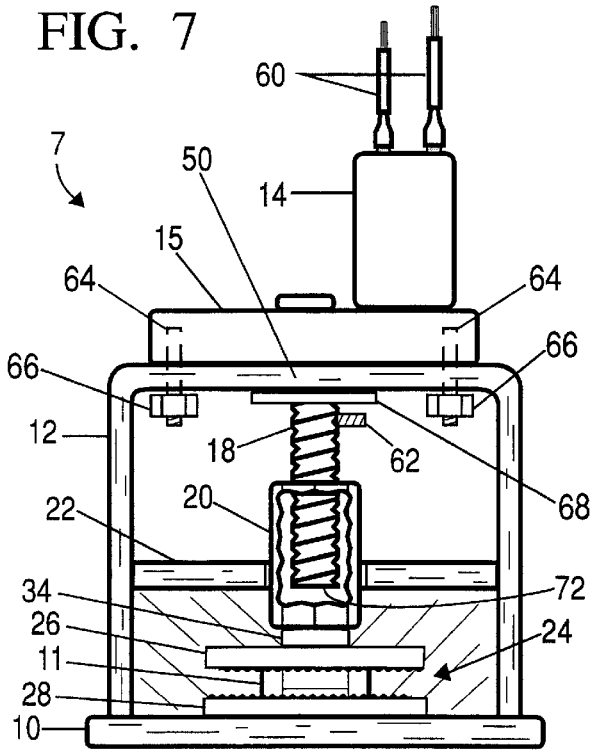
FIG. 7 is a front elevational view of the motor driven seal device of the present invention wherein the compression sleeve is in the raised or open position.

Drive rod 18 is at least partially threaded along its length with compression sleeve 20 threaded onto its second end 72 (FIG. 7). In the preferred embodiment, compression sleeve 20 is an internally threaded hex nut. By way of example, drive rod 18 is a commercially available threaded rod of ⅝ inch diameter having an 8 pitch thread. Compression sleeve 20 is a hex nut having internal threads which mate the threads of drive rod 18. It is understood that compression sleeve 20 could be of any external geometry which mates compression sleeve retainer 22.

Compression sleeve retainer 22 is affixed to, and thereby supported from base 10 in the preferred embodiment. Compression sleeve retainer 22 is affixed by any suitable means such as welding or bolting. In an alternate embodiment, compression sleeve retainer 22 could be affixed directly to frame 12 and supported thereby.

Compression sleeve retainer 22 is bent at a right angle such that it extends from base 10 and encircles compression sleeve 20. A window is cut in compression sleeve retainer 22 to allow clip tail 32 to extend therethrough.

Compression sleeve 20 is threaded onto drive rod 18. Compression sleeve retainer 22 engages compression sleeve 20 thereby preventing it from rotating. As such, rotation of drive rod 18 does not cause corresponding rotation of compression sleeve 20. Instead, rotation of drive rod 18 causes compression sleeve 20 to thread up and down along the length of drive rod 18 in response to the direction of rotation of drive rod 18. In this way, compression sleeve 20 travels in a path which is parallel to the longitudinal axis of drive rod 18. Compression sleeve retainer 22 does not restrict compression sleeve 20 from such movement. Compression sleeve 20 slides within compression sleeve retainer 22.

FIG. 6 depicts clip assembly 24 inserted within motor driven seal device 7 such that die 26 and matching counter 28 are positioned directly under compression sleeve 20. Clip tail 32 is shown extending beyond compression sleeve retainer 22 on base 10. Die 26 and counter 28 are positioned under compression sleeve 20 so that when compression sleeve 20 is driven along the length of drive rod 18, in response to rotation of drive rod 18, in the direction of base 10, compression sleeve 20 compresses die 26 into matching engagement with counter 28. A piece of paper placed between die 26 and counter 28 would thus be impressed with the indicia included on die 26.

Die 26 of clip assembly 24 may include a nib 34 thereon. Many known clip assemblies include such a nib. Nib 34 supports die 26 and receives the compression force necessary to compress die 26 into engagement with counter 28. Compression sleeve 20 may include a recess therein of a diameter to receive nib 34. Thus, engagement between compression sleeve 20 and clip assembly 24 is achieved.

Base 10 provides support for counter 28 when compression sleeve 20 compresses die 26 into counter 28. As shown, the longitudinal axes of output shaft 16, drive rod 18, and compression sleeve 20 are substantially perpendicular to base 10. In the embodiment where a separate platen is substituted for base 10, the longitudinal axes of output shaft 16, drive rod 18, and compression sleeve 20 would be substantially perpendicular to the platen.

As is shown from a side view in FIG. 6, side member 52 of frame 12 tapers in width from mounting surface 50 toward base 10 so that clip assembly 24 extends beyond side member 52. This is to allow a piece of paper to be inserted between die 26 and counter 28 unimpeded by side member 52. Notch 56 in side member 52 provides further access without extending the center of gravity of frame 12 beyond the width of side member 52 at base 10. It should be understood that the opposite side member 54 (as shown in FIG. 5) of frame 12 is similarly shaped.

FIG. 7 is a front view of motor driven seal device 7 with a clip assembly 24 inserted therein. In FIG. 7, seal device 7 is shown with compression sleeve 20 in a retracted position such that die 26 is biased away from counter 28 by clip spring 30 (FIG. 3).

Compression sleeve 20 is also shown in partial cut away in order to demonstrate the relationship between compression sleeve 20 and drive rod 18. In this retracted position, compression sleeve 20 is threaded onto second end 72 of drive rod 18 wherein compression sleeve 20 is raised toward mounting surface 50. Compression sleeve 20 slides within compression sleeve retainer 22, without rotating, thereby traveling along the length of drive rod 18 in response to rotation of drive rod 18 by gear motor 14. As such, the effective length of the combination of drive rod 18 threaded within compression sleeve 20 is reduced.

In the raised position depicted in FIG. 7, wherein compression sleeve 20 is retracted onto the length of drive rod 18, clip assembly 24 may be easily inserted or removed. This is accomplished by manually compressing die 26 toward counter 28 a sufficient amount such that nib 34 clears compression sleeve 20. Clip assembly 24 is then slid out from seal device 7. Clip assembly 24 is inserted in reverse fashion. The pressure biasing die 26 from counter 28, nib 34 extending into compression sleeve 20, along with clip tail 32 extending through the back of compression sleeve retainer 22 (discussed further below) together retain clip assembly 24 within seal device 7.

Figure 8:
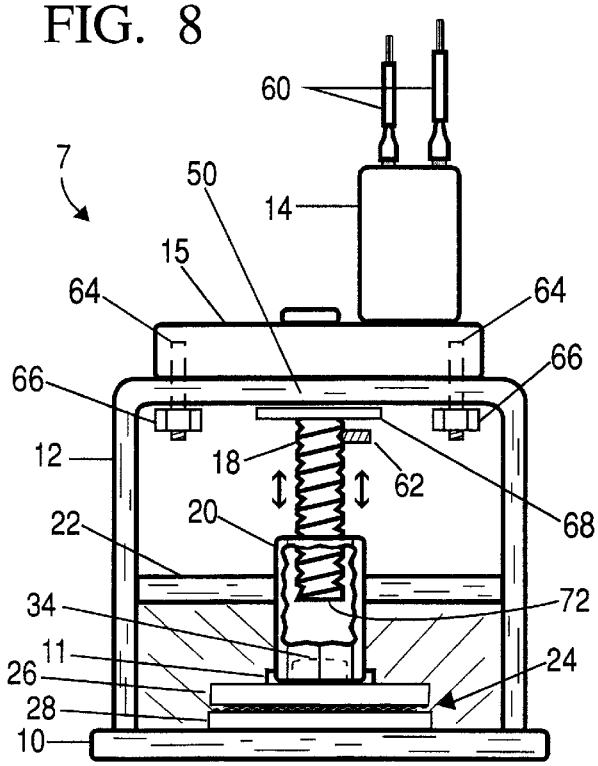
FIG. 8 is a front elevational view of the motor driven seal of FIG. 6 wherein the compression sleeve is in the lowered or closed position.

FIG. 8 is the same view as FIG. 7 with the exception that in FIG. 8, the effective combined length of drive rod 18 and compression sleeve 20 is increased such that compression sleeve 20 compresses die 26 into engagement with counter 28 of clip assembly 24. In response to rotation of drive rod 18 by gear motor 14, from the position shown in FIG. 7, compression sleeve 20 slides within compression sleeve retainer 22, without rotating, traveling along the length of drive rod 18 toward base 10. As can be seen in a comparison of FIG. 7 with FIG. 8, the length of drive rod 18 remains unchanged. The effective length of the combination of drive rod 18 and compression sleeve 20 is increased and decreased by compression sleeve 20 threading along the length of drive rod 18 sliding within but being restrained from rotation by compression sleeve retainer 22. Compression sleeve 20 moves in response to rotation of drive rod 18 by gear motor 14. Clip assembly 24, inserted between compression sleeve 20 and base 10, is compressed so that die 26 is in engagement with matching counter 28.

In FIG. 8, compression sleeve 20 is also shown in partial cut away in order to further demonstrate the relationship between compression sleeve 20 and drive rod 18 in the compressed position. In this extended compression position, compression sleeve 20 is threaded onto second end 72 of drive rod 18 wherein compression sleeve 20 is lowered toward base 10. Compression sleeve 20 contacts die 26 forcing it toward counter 28. Compression sleeve 20 encompasses nib 34. A piece of paper inserted between die 26 and counter 28 is impressed with the embossing seal contained in die 26. As stated previously, when drive rod 18 and compression sleeve 20 are in this compressed position, a reverse force is exerted on drive rod 18. This force is then applied to thrust washer 68. Thrust washer 68 transfers this force to mounting surface 50, and thereby, dissipated through the rest of frame 12.

Figure 9:
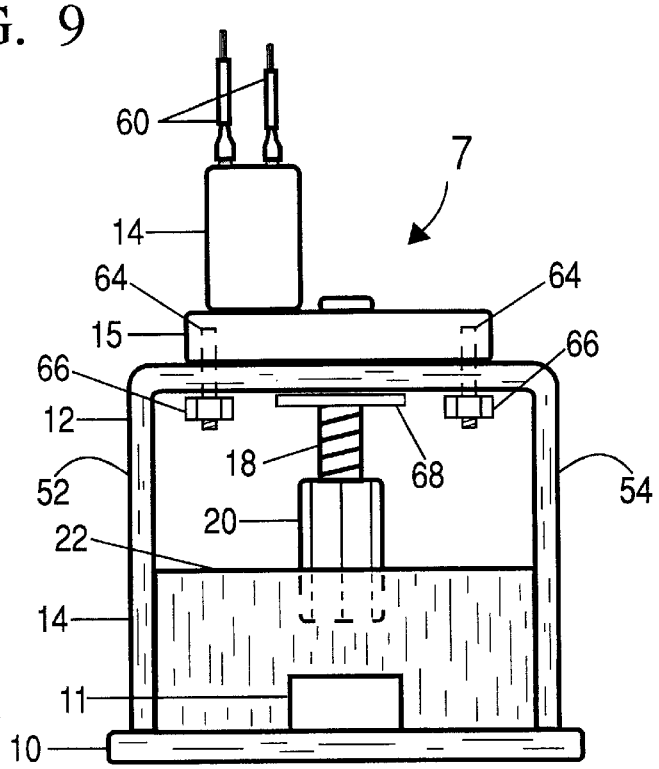
FIG. 9 is a back elevational view of the motor driven seal device of the present invention wherein the seal clip assembly is removed.
Figure 10:
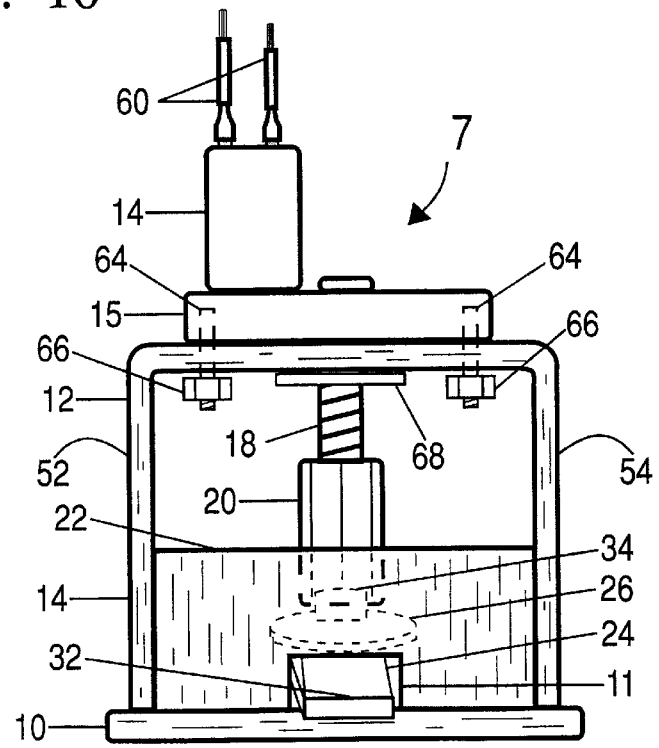
FIG. 10 is the motor driven seal device of FIG. 9 with the seal clip assembly inserted between the compression sleeve and the base such that the clip tail extends through the back of the frame.

FIGS. 9 and 10 are back views of motor driven seal device 7. In FIG. 9, the clip assembly is removed in order to show window 11 cut in the back, vertical portion of compression sleeve retainer 22. Window 11 allows the tail of the clip assembly to extend therethrough. In the preferred embodiment, the back of compression sleeve retainer 22 extends the entire width of seal device 7 between side members 52 and 54.

In FIG. 10, clip assembly 24 is installed in seal device 7 so that die 26 and nib 34 are positioned directly under compression sleeve 26. Clip tail 32 is shown extending through the back of compression sleeve retainer 22.

Compression sleeve 20 is in its raised position. In this raised position, clip assembly 24 may be inserted and removed from seal device 7 as described above.

While the invention has been described with a certain degree of particularity, it is manifest that many changes may be made in the details of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A motor driven seal device, comprising:

a base;

a frame extending from said base;

a gear motor mounted to said frame;

a threaded drive rod having a length, a first end, and a second end wherein said first end of said threaded drive rod is drivingly engaged with said gear motor and said second end extends from said gear motor toward said base;

an internally threaded compression sleeve threaded onto said second end of said threaded drive rod capable of travel along the length of said drive rod;

a compression sleeve retainer supported from said frame and engaging said compression sleeve for preventing rotation of the compression sleeve without restricting its travel along the length of said drive rod;

a seal clip inserted between said compression sleeve and said base.

2. The motor driven seal device of claim 1 wherein said compression sleeve is a hex nut.

3. The motor driven seal device of claim 1 wherein the length of said drive rod is substantially perpendicular to said base.

4. The motor driven seal device of claim 1 wherein said gear motor includes an output shaft which extends through said frame and drivingly engages said drive rod.

5. The motor driven seal device of claim 4 wherein said output shaft extends through a thrust washer inserted between said frame and said drive rod.

6. The motor driven seal device of claim 1, comprising:

an embossing seal including a die and counter;

a clip spring to bias said die from said counter;

said clip spring terminating at a clip tail;

said clip tail extending through said frame.

7. The motor driven seal device of claim 6 wherein said seal clip includes a nib and said compression sleeve includes a receiver into which said nib is inserted.

8. A motor driven seal device, comprising:

a base;

a frame supported from said base;

a gear motor supported from said frame;

said gear motor including an output shaft having a longitudinal axis such that said longitudinal axis of said output shaft is substantially perpendicular to said base;

a drive rod having a first end, a second end, and a longitudinal axis;

said first end of said drive rod being drivingly engaged with said output shaft with said longitudinal axis of said output shaft coincident with said longitudinal axis of said drive rod such that rotation of said output shaft by said gear motor translates into rotation of said drive rod;

said second end of said drive rod extending toward said base;

a compression sleeve;

said compression sleeve secured to said second end of said drive rod capable of travel along said longitudinal axis of said drive rod in response to rotation of said drive rod by said gear motor;

a compression sleeve retainer supported from said frame for preventing rotation of said compression sleeve without restricting its travel;

an embossing seal inserted between said compression sleeve and said base.

9. The motor driven seal device of claim 8 wherein said compression sleeve is a hex nut.

10. The motor driven seal device of claim 8 wherein said output shaft extends into said drive rod.

11. The motor driven seal device of claim 10 including a thrust washer inserted between said frame and said drive rod such that said output shaft extends through said thrust washer.

12. The motor driven seal device of claim 8, comprising:

an embossing seal including a die and mating counter;

a clip spring to bias said die from said counter;

said clip spring terminating at a clip tail;

said clip tail extending through said frame.

13. The motor driven seal device of claim 12 wherein said seal clip includes a nib and said compression sleeve includes a receiver into which said nib is inserted.

14. A motor driven seal device, comprising:

a frame;

a motor supported from said frame;

said motor including an output shaft having a longitudinal axis;

a drive rod having a first end, a second end, and a longitudinal axis;

said drive rod being at least partially threaded on its second end;

said first end of said drive rod being drivingly engaged with said output shaft;

said longitudinal axis of said output shaft being coincident with said longitudinal axis of said drive rod such that rotation of said output shaft by said motor translates into rotation of said drive rod;

an internally threaded compression sleeve threaded onto said second end of said drive rod;

said compression sleeve capable of travel along said longitudinal axis of said drive rod in response to rotation of said drive rod by said motor;

a compression sleeve retainer supported from said frame and engaging said compression sleeve for preventing rotation of the compression sleeve without restricting its travel;

a platen supported from said frame spaced from said compression sleeve;

an embossing seal inserted between said compression sleeve and said platen in said space.

15. The motor driven seal device of claim 14 wherein said compression sleeve is a hex nut.

16. The motor driven seal device of claim 14 wherein the length of said drive rod is substantially perpendicular to said base.

17. The motor driven seal device of claim 14 wherein said output shaft extends into said drive rod.

18. The motor driven seal device of claim 17 including a thrust washer inserted between said frame and said drive rod.

19. The motor driven seal device of claim 14, comprising:

an embossing seal including a die and mating counter;

a clip spring to connect said die and said counter to bias said die from said counter;

said clip spring terminating at a clip tail;

said clip tail extending through said frame.

20. The motor driven seal device of claim 19 wherein said seal clip includes a nib and said compression sleeve includes a receiver into which said nib is inserted.

* * * * *